United States Patent [19]

Kurtz

[11] 3,930,579

[45] Jan. 6, 1976

[54] MULTIPACK MEANS FOR PACKAGING A PLURALITY OF CATHODE RAY TUBES

[75] Inventor: Joseph M. Kurtz, Ottawa, Ohio

[73] Assignee: GTE Sylvania Incorporated, Stamford, Conn.

[22] Filed: Apr. 16, 1975

[21] Appl. No.: 568,519

[52] U.S. Cl. ..... 206/419; 206/433; 206/523; 206/497; 229/14 C; 206/45.34

[51] Int. Cl.[2] ..... B65D 85/42; B65D 65/00; B65D 85/30

[58] Field of Search.... 206/418, 523, 521, 419–422, 206/433, 497, 45.14, 45.34; 229/14 C, 39 B

[56] References Cited

UNITED STATES PATENTS

| | | | |
|---|---|---|---|
| 3,363,753 | 1/1968 | Taylor | 206/422 |
| 3,750,871 | 8/1973 | Cook | 206/433 |

*Primary Examiner*—William Price
*Assistant Examiner*—Douglas B. Farrow
*Attorney, Agent, or Firm*—Norman J. O'Malley; Frederick H. Rinn; Robert T. Orner

[57] ABSTRACT

An improved multipack container is provided for accommodating a plurality of cathode ray tubes during transportation and storage. The altered construction includes basic top and bottom rigid closure members formed of flame retardant plastic material. Positioned peripherally therebetween are two substantially U-shaped edge-oriented areal support members, such being opposingly located between the superjacently related ledges of the respective closure members. Since the forward portions of the U-shaped supports do not meet, a beneficial window opening is provided on either side of the multipack structure. Internal supportive and protective structural means are predeterminately located between the closures in a manner spaced from the peripheral support members. Upon assembly of the multipack container and placement of the tubes therein, a tight covering of plastic material is applied to contiguously encompass the complete multipack to provide a unitized assemblage. The reinforced construction effects a firmly secured multipack having flame retardative features, improved structural rigidity and enhanced protective characteristics.

6 Claims, 3 Drawing Figures

MULTIPACK MEANS FOR PACKAGING A PLURALITY OF CATHODE RAY TUBES

CROSS REFERENCE TO RELATED APPLICATION

This application contains matter disclosed but not claimed in a related United States patent application filed concurrently herewith and assigned to the assignee of the present invention. This related application is Ser. No. 568,520.

BACKGROUND OF THE INVENTION

This invention relates to the accommodation of cathode ray tubes and more particularly to improved means for protectively packaging a plurality of tubes for transportation and storage. In general, cathode ray tubes by the nature of their usual glass construction are inherently fragile structures. Therefore, in storing and transporting quantities of tubes, careful consideration must be directed to achieving appropriate packaging means. For some time, it has been conventional practice to transport and store pluralities of tubes in packaging means commonly referred to as multipacks or multipack containers. Depending upon the size of the tubes concerned, such containers are normally designed to accommodate six or more tubes per unit. In the fabrication of this type of multiple tube packaging, it has been a common practice to utilize a combination of substantially combustible corrugated paperboard components, such being individually cut, formed and interlocked to produce an integrated container means. Such construction requires a number of expensive die-cut pieces to provide the container shell, along with several necessary internal structural components which are folded and assembled thereinto, to fabricate a container having the requisite strength to sufficiently support the plurality of tubes and adequately protect them against damage during storage and transportation. When loaded with tubes, such multipack containers are usually additionally reinforced by two or more tautly drawn encircling metallic bands. While these bands are beneficial for maintaining the integrated structure, especially when pelletized, they sometimes become ensnared in forklift handling operations, whereupon the container and tubes therein may be damaged. Additionally, multipacks fabricated entirely of corrugated paperboard have an inherent shortcoming in that the material is prone to readily absorb ambient humidity, whereupon the structural rigidity of the container becomes weakened thereby diminishing the supportive protection of the contents therein. This becomes an important factor when considering stacked storage arrangements.

While multipack storage and transportation facilities are constituted to minimize the hazards of combustibility, an important consideration under constant surveillance is the probable inflammable nature of the packing materials utilized.

A recent development in multipack construction involves a container whereof the top and bottom closure members are formed of expanded plastic material in place of the usual paperboard closure components. But, the continued usage of a continuous perimetrical sidewall of corrugated paperboard and the contiguous internal bridging supportive means manifest the previously mentioned disadvantages.

From a convenience consideration, another shortcoming evidenced in conventional multipack packaging is the inherent opacity of the completely enclosed construction of the container. Unless the reinforcing bands are removed and the multipack opened, there is no convenient way of assessing the completeness or condition of the physical contents accommodated therein.

OBJECTS AND SUMMARY OF THE INVENTION

It is an object of the invention to reduce the aforementioned disadvantages by providing an improved cathode ray tube multipack structure having flame retardative features and improved structural rigidity. Another object is to provide a cathode ray tube multipack container having window means therein.

The foregoing and other objects and advantages are achieved in one aspect of the invention by the provision of an improvement in multipack construction which imparts structural rigidity, window means and flame retardant properties to the container. The improved construction includes two similar, spaced-apart and inversely superposed tray-like members fabricated of substantially rigid flame retardant plastic material, conjunctively serving as top and bottom closure members. Each of these tray-like structures has a plurality of configurated cavities formed therein to accommodate the placement and retention of a portion of the contourial surface of each of the tubes placed therein. Two substantially U-shaped edge-positioned support members are peripherally located in opposed orientation between the related ledges of the top and bottom closure members. Each of these edge support members is formed of substantially rigid-board material symmetrically folded in a predetermined vertical manner to provide a square-cornered structure of substantially U-shaping. The two extremital wing portions extend along the ledges of opposed sides of each closure member for a distance less than one-half of the longitudinal dimension of that side. A forward section of each wing portion is folded inwardly to provide four reinforcing edge folds which are separated from one another to effect a window opening therebetween on both sides of the multipack structure. Internal supportive and protective structural means are predeterminately spaced from the two peripherally oriented support members. A tight covering of plastic material encompasses the assembled multipack structure including the tubes and the internal members positioned therein. This ambient covering beneficially utilizes and reinforces the multipack structure having window means therein, thereby providing improved structural rigidity and protection for the flame retardative integration and contents as a whole.

DESCRIPTION OF THE PREFERRED EMBODIMENT

For a better understanding of the present invention, together with other and further objects, advantages, and capabilities thereof, reference is made to the following specification and appended claims in connection with the aforedescribed drawings.

While the ensuing description is primarily directed to an exemplary multipack structure for accommodating six cathode ray tubes, the concept of the improved packaging structure is likewise applicable for the handling of larger or smaller numbers of tubes.

Figure 1:
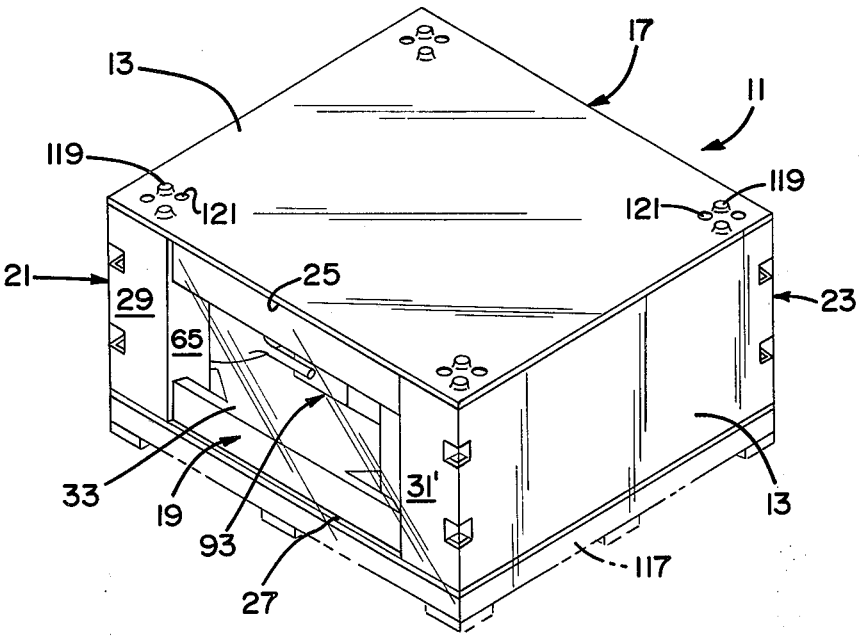
FIG. 1 is a perspective of the improved plastic-covered multipack structure of the invention.

With reference to the drawings, FIG. 1 illustrates a single multipack container 11 fabricated in accordance with the invention and having a taut covering of plastic film 13 applied thereover to provide an encompassing binding to the whole integrated structure. The two spaced-apart and inversely superposed tray-like top and bottom closure members, 17 and 19, have two substantially similar U-shaped edge-positioned areal support members, 21 and 23, opposingly oriented in a peripheral manner between the respective ledges, 25 and 27, thereof. Opposing extremital wing portions 29 and 31' of the respective U-shaped support members 21 and 23 are separated in a manner to define a window means 33 therebetween, through which the internal contents of the multipack container 11 can be viewed.

Figure 3:
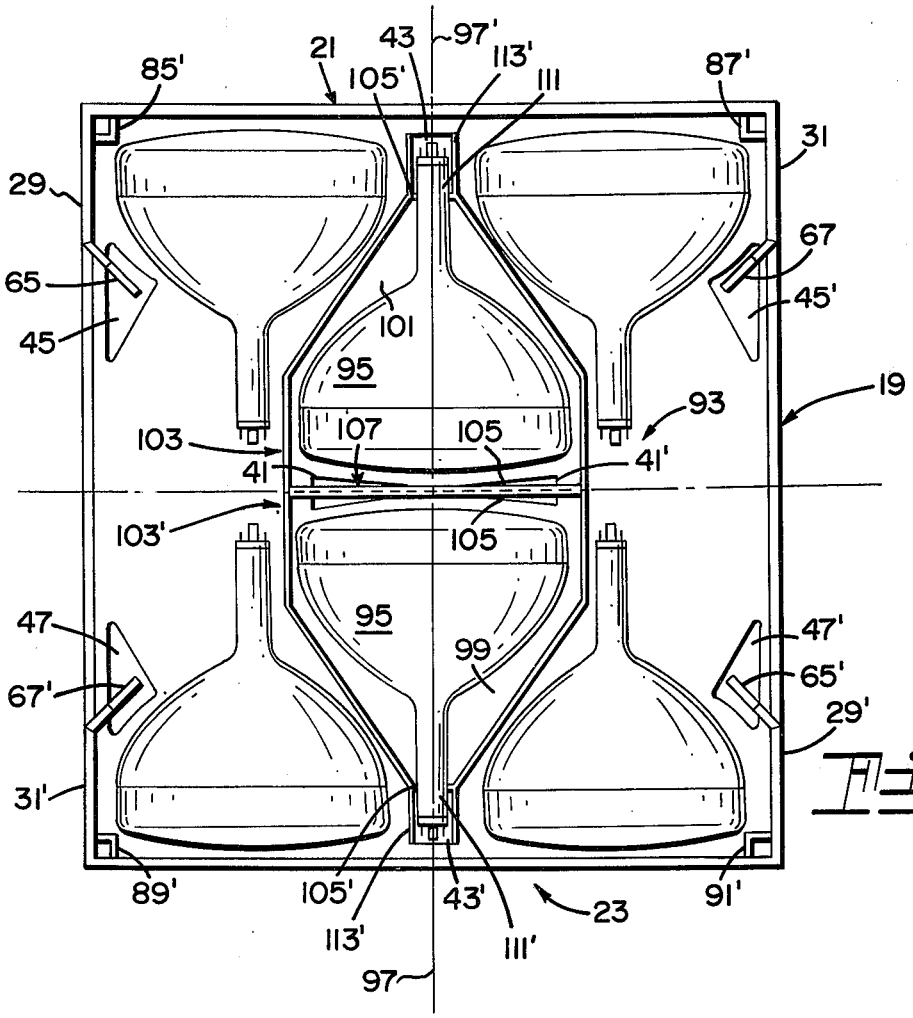
FIG. 3 is a plan view of the tray-like bottom closure member illustrating the positioning of the opposingly oriented U-shaped edge-support members and the spatially related internal supportive and protective structural means.
Figure 2:
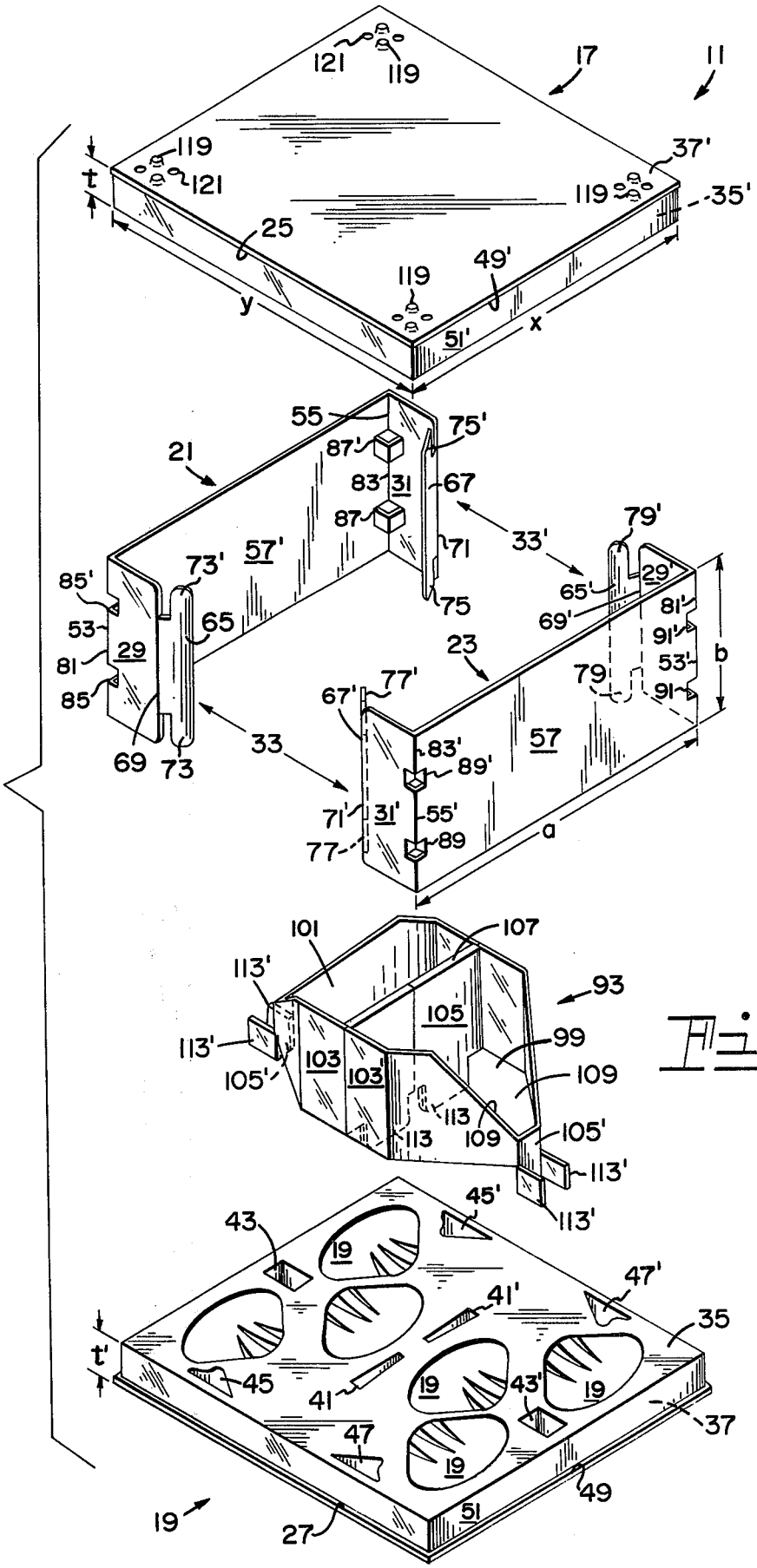
FIG. 2 is an exploded view of the improved multipack construction delineating the respective parts thereof.

Additional attention is directed to FIGS. 2 and 3 wherein the cooperating structural components of the multipack container 11 are further delineated.

The top and bottom closures 17 and 19 are similar, inversely superposed tray-like members formed of substantially rigid plastic material. Each of these closure members has a structural thickness *t*, *t'* defined by spatially related interior 35, 35' and exterior 37, 37' parallel planes which are bounded by four walls therearound. While each of the closure trays is similarly formed, for descriptive purposes reference is directed to the bottom closure member 19, wherein a plurality of configurated cavities 39 are formed internally of the interior plane 35, to accommodate the placement and retention of approximately 20 percent of the contourial surface of each of the respective tubes positioned therein. Thus, within the subsequently closed multipack structure, approximately 40 percent of each tube is retentively accommodated by the opposingly oriented and conjunctively related closure members. Additionally, a plurality of recesses, 41–41', 43–43', 45–45', and 47–47' are likewise formed in the closure members to receive discrete tabular elements associated with the respective componental members comprising the improved multiplex container 11. The exterior plane 35, 35' of each tray-like structure has a related peripheral ledge portion 49, 49' outstanding from the walls 51, 51' therearound.

The upstanding sides of the multipack construction are formed of two similar substantially U-shaped edge-positioned areal support members, 21 and 23, opposingly oriented peripherally between the related ledges 49, 49' of the top and bottom closures. These side support members have major and minor dimensioning *a* and *b* of which the minor dimensioning *b* equals the distance between the respective opposed ledges 25 and 27. Structurally, the side support members 21, 23 are formed of substantially rigid-board material which is symmetrically folded in a predetermined vertical manner along score lines 53–53' and 55–55' which are parallel to the minor dimensioning *b* to provide a square cornered structure of substantially U-shaping. Each of these structures defines an areal central portion 57–57' from which an extremital wing portion 29–29', 31–31' projects from either side thereof. The central portion 57 has a major dimension *a* which coincides with the longitudinal dimension *x* of the associated two superposed walls of the opposed closure members 17, 19. The aforementioned projecting wings 29, 31 are seated on and extended in a contiguous manner along the ledges of the opposed walls of the closure members for a distance less than one-half the longitudinal dimension *y* therealong. Thus, the opposing wing portions 29–31', and 29'–31 are separated from one another to effect a window opening 33, 33' therebetween on both sides of the multipack structure. Each wing portion has a forward section 65, 65', 67, 67' which is folded inwardly along a vertical score line to provide four reinforcing edge folds 69, 69', 71, 71' that are spacedly oriented vertically between the superposed closure members. Individually, these forward sections have top and bottom protruding tabular 73–73', 75–75', 77–77', and 79–79' means which are shaped for insertion into compatible recesses formed in each of the closure members, wherein tabular means 73, 75, 77 and 79 seat in recesses 45, 45', 47 and 47', to improve the rigidity of the multipack container. Each of the square corners, 81, 81', 83, 83' of the two opposed U-shaped support members 21 and 23 has two spaced-apart inset formations 85–85', 87–87', 89–89', and 91–91' reversely folded in a manner to provide inwardly projecting seating stops for the respective corners of the top and bottom closure members 17 and 19.

Interiorly within the multipack enclosure 11 are exemplary internal supportive and protective structural means 93 for accommodating two opposingly positioned carthode ray tubes 95 whereof their longitudinal axes 97, 97' are substantially parallel with the planes of the closure members 17 and 19. As per example, the internal structure 93, as referenced in FIGS. 2 and 3, includes first and second tube protective compartments 99 and 101 which are individually adapted for substantially encompassing the panel and funnel portions of the respective tubes positioned therein. This chambered construction is formed, for example, from a unitary sheet of substantially rigid material which is folded along a series of pre-defined score lines to provide a plurality of upstanding opposingly oriented sidewalls 103–103' and a related plurality of upstanding opposingly oriented end walls 105–105'. The primary end walls 105 of each compartment are positioned in back-to-back alignment thereby defining a dual wall terminally joined member 107 which separates the first and second compartments 99, 101. Each of the opposed secondary upstanding end walls 105' of the respective compartments has a cutout region 109 therein for substantially accommodating the neck portions 111, 111' of the respective tubes. A plurality of tabular elements 113, 113' extend from the lower edges of the dual-wall separation member 107 and the opposingly oriented secondary end walls 105' of the compartments. These tabular elements 113, and 113' are placed in the respective recesses 41–41' and 43–43' formed within the bottom closure member to effect positional attachment of the internal supporting structural means 93 upon the bottom closure member 19. It is to be noted that no portions of the internal support member 93 are in contact with any portions of the respective U-shaped side support members 21 and 23.

Upon assembling the individual internal supportive member 93 and the opposingly positioned side support members 21 and 23 upon the bottom closure 19, the respective plurality of cathode ray tubes 95 are positioned therein and the top closure member 17 seated thereupon in a manner resting upon the internal supportive member 93 to provide an integrated multipack means 11. At this stage, a plastic material is applied to the multipack as a tight covering 13 contiguously encompassing the assemblage, which may or may not be supported upon a pallet 117, as phantomed in FIG. 1. This plastic covering may be in the form of a heat shrinkable plastic bag, as shown in FIG. 1, which is suitably dimensioned to fit over the assemblage, or the encompassment may be accomplished by a stretch wrap operation; both means being well known in the packaging art. While, by way of example, the plastic covering of a single multipack unit has been shown and described, it has been found expeditious practice to symmetrically stack two or more multipack containers and encapsulate the plurality into a single integral unit. The vertical integration of multipack containers is facilitated by a plurality of placement-retention projections 119 and compatible recesses 121 formed in substantially the corner regions of the exterior surface of each closure member. These projections and recesses are oriented to effect interlocking when the closure members are positioned back-to-back as they are in a stacking arrangement.

To fully appreciate the improvement realized by the invention, several contributing aspects will be considered in greater detail. The substantially rigid tray-like closure members 17 and 19 are formed of, for example, expanded polystyrene material. By its very nature, this material provides the necessary rigidity required of the closure members and exhibits excellent cushioning and insulation characteristics for the tubes positioned therein. The tray is fabricated from a bead material formulated to produce an expanded foam that exhibits flame-retardant properties. An example of such material, is bead No. 4486, as supplied by Foster Grant Company, Inc., Leominster, Mass. The material content of the molded tray has a density in the order of 1.75 to 2.00 pounds per cubic foot.

The two edge-positioned side support members 21 and 23 and the internal supportive member 93 are fabricated of substantially rigid-board material that lends itself to defined folding along predetermined score lines. Suitable materials for this utilization are for example, plastic corrugated board or corrugated paperboard. While these materials may be inflammable, they can be formulated to exhibit flame-retardative properties. Nevertheless, the three cooperating support members 21, 23 and 93 are oriented in the multipack construction in a manner that no two members touch one another. Thus, if they are formed of combustible material, the isolation of the respective members, and their discrete orientation between flame-retardative closure members, provide an advantageous multipack structure which exhibits improved flame retardative characteristics as a whole.

As previously mentioned, the contiguous external covering of plastic material 13 may be, for example, a bag or shroud fitted over one or more multipack containers in stacked arrangement. A number of known heat shrinkable plastic materials are suitable for this application, one of which is polyethylene of 0.003 to 0.005 of an inch thickness, such being structurally preferentially oriented during material fabrication to have substantially greater primary shrinkage in the vertical direction. The encompassing bag 13 is made to have an added depth or length of at least 6 inches to provide an overhang or extra length which is shrunk to the bottom of the bottom closure or to the bottom of the deck board of a pallet, if such is used. A suitable oven known to the art is utilized to effect uniform shrinkage of the bag thereby tightly wrapping the multipack integration 11.

The external plastic covering may also be applied by utilizing a stretch plastic film that is formulated to have cling characteristics. This type of film is applied at a substantially continuous spiral wrapping which is disposed in two directions to provide a complete wrapping.

The improved multipack structure of this invention, provides several outstanding features and advantages not evidenced in the contemporary cathode ray tube packaging art. The separated and discretely formed support members in the multipack integration are discretely folded to add beneficial rigidity to the structure. In addition, the individual support members are isolated from one another to create fire barrier spacings therebetween. The separation of the side support elements produces a window on either side of the multipack container which facilitates visual inspection of the contents therein. The external plastic film forms a durable exterior coating which provides additional surface protection for the closures and the side supporting members therebetween, and produces a tight unitization of the integrated package.

While there has been shown and described what are at present considered the preferred embodiments of the invention, it will be obvious to those skilled in the art that various changes and modifications may be made therein without departing from the scope of the invention as defined by the appended claims.

What is claimed is:

1. An improvement in multipack container for accommodating a plurality of cathode ray tubes wherein the tubes and related internal supportive and protective structural members are oriented between two spaced-apart and inversely superposed tray members of substantially rigid material conjunctively serving as top and bottom closure members of the multipack container, each of the tray-like closure members evidences a structural thickness defined by spatially related interior and exterior parallel planes bounded by four walls therearound, a plurality of configurated cavities are formed in each of the tray structures internally of the interior plane to accommodate the placement and retention of a portion of the contourial surface of the respective tubes, the exterior plane of each closure member has a related peripheral ledge portion outstanding from the walls therearound, said improvement providing structural rigidity and flame retardant properties to said multipack comprising:

two substantially U-shaped peripherally edge-positioned areal support members having major and minor dimensionings located in opposed orientation between the ledges of said top and bottom closure members, whereof said minor dimensioning equals the distance between said ledges, said closure members being fabricated of flame retardant material, each of said edge support members being formed of a substantially rigid-board material symmetrically folded in a predetermined vertical manner along score lines parallel to said minor dimensioning to provide a square-cornered structure of substantially U-shaping defining an areal central portion with two extremital wing portions projecting thereform, said central portion having a major dimension coinciding with the longitudinal dimensions of the two superposed walls of said top and bottom closure members, said projecting wings being seated on and contiguously extended along the ledges of opposed walls of each closure member for a distance less than one-half the longitudinal dimension therealong, the forward section of each wing portion being folded inwardly to provide four reinforcing edge folds oriented vertically between the superposed closure members, said folds of the opposed forward sections being separated from one another to effect a window opening therebetween on both sides of said multipack structure, said internal supportive and protective structural means being predeterminately spaced from said peripheral support members; and a tight covering of plastic material contiguously encompassing the assembled multipack means including the tubes and the internal members positioned therein, said ambient covering effecting a beneficially utilized and reinforced multipack structure thereby providing improved structural rigidity and enhanced protection for the flame retardative integration and contents as a whole.

2. The improved multipack container according to claim 1 wherein each of the square corners of said two opposed support members has two spaced-apart inset formations reversely folded to provide inwardly projecting seating stops for the corners of said superposed top and bottom closure members.

3. The improved multipack container according to claim 1 wherein each of said forward sections related to the respective vertical folds in the projecting wing portions has a top and bottom protruding tabular member individually shaped for insertion into a compatible recess formed in each of said closure members to improve the rigidity of the multipack container.

4. The improved multipack container according to claim 1 wherein said multipack assembly is positioned on a pallet member in a manner that said plastic wrapping includes said pallet member to provide a multipack-pallet assembly.

5. The improved multipack container according to claim 1 wherein said substantially rigid board material is of corrugated fabrication, and wherein said rigid closure members are constituted of a substantially rigid plastic foam material.

6. The improved packaging means for cathode ray tubes according to claim 1 wherein a plurality of size-related multipacks are vertically stacked and incorporated within a common wrapping of plastic to provide a plurally integrated multipack assemblage.

* * * * *

UNITED STATES PATENT OFFICE
CERTIFICATE OF CORRECTION

PATENT NO. : 3,930,579
DATED : January 6, 1976
INVENTOR(S) : Joseph M. Kurtz

It is certified that error appears in the above-identified patent and that said Letters Patent are hereby corrected as shown below:

Col. 2, line 51: "beneficially utilizes" should read ---
beneficially unitizes ---

Col. 7, line 30: "beneficially utilized" should read ---
beneficially unitized ---

Signed and Sealed this
*twenty-third* Day of *March 1976*

[SEAL]

*Attest:*

RUTH C. MASON
*Attesting Officer*

C. MARSHALL DANN
*Commissioner of Patents and Trademarks*